US005697553A

United States Patent [19]

Stotts

[11] Patent Number: 5,697,553

[45] Date of Patent: Dec. 16, 1997

[54] STREAKED SPRAY NOZZLE FOR ENHANCED AIR/FUEL MIXING

[75] Inventor: Robert E. Stotts, Newark, N.Y.

[73] Assignee: Parker-Hannifin Corporation, Cleveland, Ohio

[21] Appl. No.: 397,799

[22] Filed: Mar. 3, 1995

[51] Int. Cl.[6] ..... B05B 7/06

[52] U.S. Cl. ..... 239/8; 239/424; 239/406

[58] Field of Search ..... 239/400, 403–406, 239/399, 416.4, 416.5, 423, 424

[56] References Cited

U.S. PATENT DOCUMENTS

| | | | |
|---|---|---|---|
| 3,013,732 | 12/1961 | Webster et al. . | |
| 3,024,045 | 3/1962 | Cleminshaw et al. . | |
| 3,028,102 | 4/1962 | Davies et al. . | |
| 3,029,029 | 4/1962 | Webster . | |
| 3,474,970 | 10/1969 | Simmons et al. . | |
| 3,946,552 | 3/1976 | Weinstein et al. | 239/400 X |
| 3,972,182 | 8/1976 | Salvi | 239/404 X |
| 3,979,069 | 9/1976 | Garofalo . | |
| 3,980,233 | 9/1976 | Simmons et al. . | |
| 4,139,157 | 2/1979 | Simmons . | |
| 4,168,803 | 9/1979 | Simmons et al. . | |
| 4,365,753 | 12/1982 | Harding et al. . | |
| 4,595,143 | 6/1986 | Simmons et al. . | |
| 4,613,079 | 9/1986 | Mains . | |
| 4,616,784 | 10/1986 | Simmons et al. . | |
| 4,754,922 | 7/1988 | Halvorsen et al. | 239/406 X |
| 5,067,655 | 11/1991 | Farago et al. . | |
| 5,105,621 | 4/1992 | Simmons et al. . | |
| 5,251,823 | 10/1993 | Joshi et al. | 239/400 X |

FOREIGN PATENT DOCUMENTS

| | | | |
|---|---|---|---|
| 265947 | 12/1949 | Switzerland | 239/404 |
| 385 | of 1914 | United Kingdom | 239/399 |
| 702215 | 1/1954 | United Kingdom | 239/399 |

OTHER PUBLICATIONS

Simmons, Harold C., Booklet entitled "The Atomization of Liquids", 1979.

*Primary Examiner*—Kevin Weldon

*Attorney, Agent, or Firm*—Renner, Otto, Boisselle & Sklar, P.L.L.

[57] ABSTRACT

A spray nozzle comprising a nozzle body and a swirl chamber in the nozzle body, the swirl chamber extending axially from a back wall of the swirl chamber to a discharge orifice axially opposite the back wall. The nozzle further comprises a plurality of fluid channels opening to the swirl chamber for conveying fluid from an inlet to the swirl chamber. The fluid channels are disposed to cause swirling of the fluid within the swirl chamber for discharge through the discharge orifice to form a conical spray, and the fluid channels each have a center line projection thereof at least partially radially overlapping the discharge orifice. This construction enables the formation of higher density streaks in the conical spray, which higher density streaks have higher kinetic energy than the lower density mist of the conical spray between the streaks for improved penetration into an air stream, as may be desired for mixing fuel with combustion air, as in a gas turbine combustion system.

27 Claims, 4 Drawing Sheets

STREAKED SPRAY NOZZLE FOR ENHANCED AIR/FUEL MIXING

The invention herein described relates generally to nozzles and, more particularly, to nozzles for providing atomized fuel to a combustion chamber.

BACKGROUND

Many types of nozzles for atomizing liquid fuel are known in the prior art. For satisfactory combustion of the fuel, complex and sophisticated fuel nozzles have been developed to atomize the fuel into a fine spray of small droplets for mixing with combustion air. In many nozzles, fuel is supplied at high pressure to a swirl chamber in which a free vortex is formed. The fuel leaves the swirl chamber through a discharge orifice in the form of a thin conical sheet surrounding a core of air. As the thin conical sheet moves away from the discharge orifice it breaks up into a conical spray of drops. These nozzles are commonly referred to as pressure atomizers. In some instances, two pressure atomizers are combined for delivering fuel into the combustion chamber to provide a nozzle having a higher fuel flow range or for delivering fuel and another liquid, such as water, for intermixing with the fuel and combustion air. This type of nozzle is generally referred to as a dual orifice nozzle, an example of which is shown in U.S. Pat. No. 3,013,732. To obtain improved atomization, the single or dual orifice nozzles may be air-assisted, i.e., use high velocity and/or high pressure air as a means for better atomizing the thin conical sheet of fuel. An example of an air-assisted nozzle is shown in U.S. Pat. No. 3,912,164.

Conventional gas turbine combustion systems have used one or more nozzles to introduce fuel into the combustion air which is usually swirling. Many if not most nozzles produce uniform conical sprays, with one spray cone or two concentric spray cones per combustion air swirler. Some nozzles use multiple discrete fuel jets alone or combined with a central uniform conical spray.

Conventional practice has been to design the swirl nozzles such that they produce an evenly circumferentially distributed spray for even mixing with combustion air. However, the kinetic energy of the typical uniform spray cone decreases rapidly with distance from the nozzle. Therefore, the fuel spray should originate close to the combustion air stream so that the kinetic energy of the fuel spray can provide adequate penetration into and mixing with the combustion air. However, in some combustion system designs the fuel spray must travel a relatively long distance from the nozzle to the combustion air. In these cases the fuel spray may not have enough kinetic energy to penetrate and mix well with the combustion air before burning, with the result being poor combustion performance.

SUMMARY OF THE INVENTION

The present invention provides a novel spray nozzle that overcomes the aforesaid problem. The spray nozzle comprises a nozzle body and a swirl chamber in the nozzle body, the swirl chamber extending axially from a back wall of the swirl chamber to a discharge orifice axially opposite the back wall. The nozzle further comprises a plurality of fluid channels opening to the swirl chamber for conveying fluid from an inlet to the swirl chamber. At least one of these fluid channels is disposed to cause swirling of the fluid within the swirl chamber for discharge through the discharge orifice to form a conical spray, and at least one of the fluid channels has a center line projection thereof at least partially radially overlapping the discharge orifice. This construction enables the formation of at least one higher density streak in the conical spray, which higher density streak has higher kinetic energy than the lower density mist of the conical spray for improved penetration into an air stream, as may be desired for mixing fuel with combustion air, as in a gas turbine combustion system.

According to a preferred embodiment, more than one of the fluid channels each has a center line projection thereof at least partially radially overlapping the discharge orifice, whereby a plurality of higher density streaks are produced in the conical spray. The fluid channels are equally circumferentially spaced apart and preferably are formed by respective swirl channels opening tangentially to the swirl chamber with a center line projection of each the swirl channel having radially inner and outer portions respectively intersecting and not intersecting the discharge orifice.

Further in accordance with the present invention, the nozzle body includes an outer body member forming a conical side wall surface of the swirl chamber that terminates at the discharge orifice, and an inner body member cooperating with the conical side wall surface to define the swirl chamber. The inner body member has a conical portion for mating with the conical side wall surface, and the conical portion has formed therein a plurality of swirl slots forming the swirl channels. The swirl slots have a radial depth such that a center line projection of the swirl slots partially radially overlaps the discharge orifice.

According to another aspect of the invention, a spray nozzle comprises a nozzle body including an outer body member forming a conical side wall surface of a swirl chamber that terminates at a circular discharge orifice, and an inner member cooperating with the outer conical side wall surface to define the swirl chamber. A plurality of swirl channels in the inner member open tangentially to the swirl chamber for introducing fluid into the swirl chamber to cause swirling of the fluid within the swirl chamber for discharge through the discharge orifice to form a conical spray. The swirl channels have center lines that define at the back wall of the swirl chamber a circle coaxial with the discharge orifice. This circle, in contrast to the prior art, has a diameter about equal or less than the discharge orifice, whereby a plurality of higher density streaks are produced in the conical spray.

According to a further aspect of the invention, a spray nozzle comprises a nozzle body, a swirl chamber in the nozzle body, the swirl chamber extending axially from a back wall of the swirl chamber to a discharge orifice axially opposite the back wall, and means opening to the swirl chamber for conveying fluid from an inlet to the swirl chamber, the conveying means being operative to cause swirling of the fluid within the swirl chamber for discharge through the discharge orifice to form a conical spray, and further being operative to produce at least one higher density streak in the conical spray. In a preferred embodiment, the conveying means comprises a plurality of channel means, one or more of the channel means being disposed to cause the fluid to jet through the discharge orifice for producing one or more higher density streaks in the conical spray, preferably in an axially symmetric pattern such as with the streaks being circumferentially equally spaced apart.

The invention also provides a method of converting a spray nozzle, the nozzle comprising a nozzle body including an outer body member forming a conical side wall surface of a swirl chamber that terminates at a circular discharge orifice, and a swirl plug cooperating with the outer conical side wall surface to define the swirl chamber, the swirl plug having a plurality of swirl channels opening tangentially to the swirl chamber for introducing fluid into the swirl chamber to cause swirling of the fluid within the swirl chamber for discharge through the discharge orifice to form a conical spray, and the swirl channels having center lines defining at the back wall of the swirl chamber a circle coaxial with the discharge orifice, the circle having a diameter greater than the discharge orifice. The method comprises the step of replacing the swirl plug with a replacement swirl plug, the replacement swirl plug cooperating with the outer conical side wall surface to define the swirl chamber, the replacement swirl plug having a plurality of swirl channels opening tangentially to the swirl chamber for introducing fluid into the swirl chamber to cause swirling of the fluid within the swirl chamber for discharge through the discharge orifice to form a conical spray, the swirl channels in the replacement swirl plug having center lines defining at the back wall of the swirl chamber a circle coaxial with the discharge orifice, and the circle having a diameter about equal or less than the discharge orifice, whereby a plurality of higher density streaks may be produced in the conical spray.

The foregoing and other features of the invention are hereinafter more fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
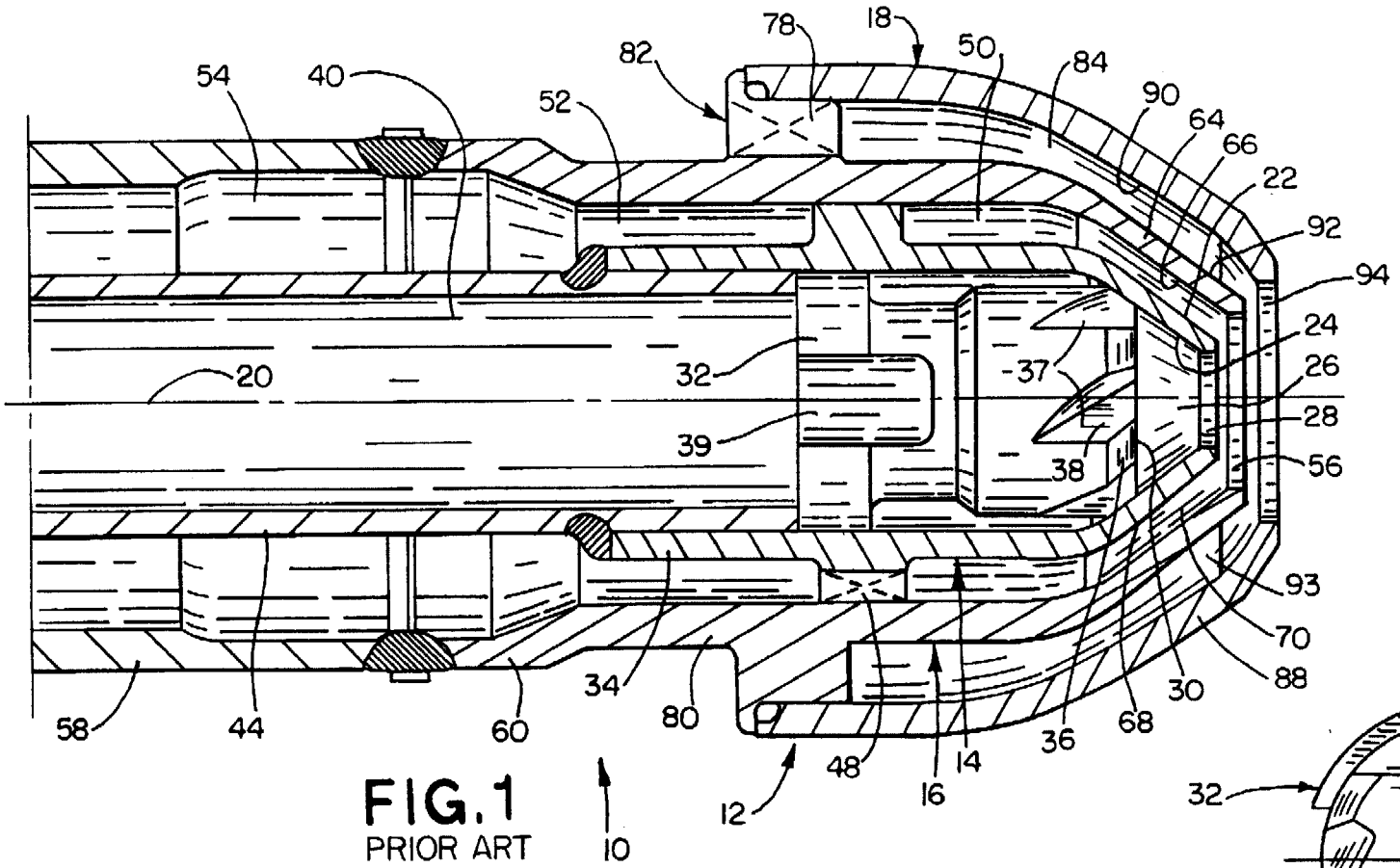
FIG. 1 PRIOR ART
FIG. 1 is a longitudinal cross-sectional view of a nozzle according to the prior art.
Figure 2:
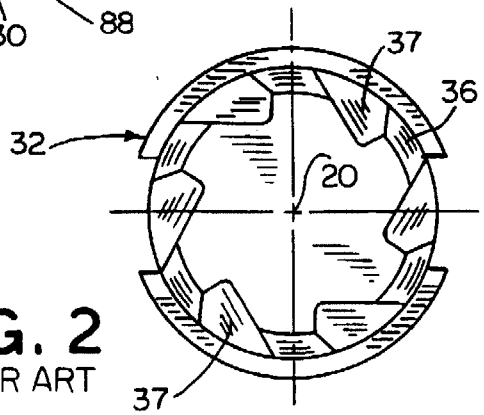
FIG. 2 PRIOR ART
FIG. 2 is an end elevational view of a swirl plug used in the nozzle of FIG. 1.

In order to facilitate an understanding of the invention, reference is first had to a spray nozzle of conventional design such as that illustrated in FIGS. 1 and 2. The prior art spray nozzle, designated generally by reference numeral 10, is a dual circuit/orifice, air assisted nozzle. The nozzle 10 comprises a nozzle body 12 including a primary nozzle body 14, a secondary nozzle body 16 and an outer air nozzle body 18. The nozzle bodies are assembled concentrically with respect to one another and the center axis 20 of the nozzle as shown.

The primary nozzle body 14 has a conical wall portion 22 which has an interior conical wall surface 24 surrounding a primary swirl chamber 26. The primary swirl chamber 26 converges on a circular primary discharge orifice 28 defined by the leading edge of the conical wall portion 22 at the front end of the primary nozzle body 14. The rear end of the primary swirl chamber 26 axially opposite the primary discharge orifice 28 is defined by a back wall 30 formed by the front face of a swirl plug 32 located concentrically within a cylindrical portion 34 of the primary nozzle body 14.

The swirl plug 32 has a conical forward end portion (cone) 36 which seats against the interior conical wall surface 24 of the primary nozzle body 14. The cone 36 has formed in the surface thereof a plurality of swirl slots 37 which form with the interior conical wall surface respective swirl channels 38 through which a pressurized primary fluid (i.e., liquid), supplied via an inlet 39 connected to a supply passage 40, is introduced into the primary swirl chamber 26 for swirling therein and discharge out through the primary discharge orifice 28 to form a conical spray. As is well known in the art, the swirling fluid forms a free vortex whereupon the fluid issuing from the discharge orifice is initially in the form of a conical sheet that, through interaction with air and under typical operating conditions, quickly breaks up into fine drops forming a hollow conical spray. The supply passage 40 is formed by the interior passage of a tubular member or supply tube 44 over which the cylindrical portion 34 of the primary nozzle body 14 is telescoped partially and secured by suitable means such as by welding. As shown, the swirl plug 32 is axially trapped between the axial end face of the supply tube 44 and conical wall portion 22 of the primary nozzle body 14.

The primary nozzle body 14 has a plurality of swirl vanes 48 formed around the periphery of its cylindrical portion 34. The secondary nozzle body 16 is telescoped over the primary nozzle body 14 and is supported on the radially outer ends of the swirl vanes 48. Together, the primary and secondary nozzle bodies define therebetween an annulus 50 through which a secondary fluid (i.e., liquid) passes, supplied via a secondary fluid inlet 52 from a secondary fluid supply passage 54, to a secondary discharge orifice 56 which, as shown, is coaxial with and spaced slightly axially forward of the primary discharge orifice 28. The supply passage 54 is formed by the interior passage of a secondary supply tube 58 to which a cylindrical end portion 60 of the secondary nozzle body is attached as by butt welding.

The secondary nozzle body 16 has a conical wall portion 64 which has an interior conical wall surface 66 that surrounds the outer conical wall surface 68 of the conical wall portion of the primary nozzle body 14. These conical surfaces 66 and 68 are parallel and define therebetween a conical swirl annulus or chamber 70 generally surrounding the primary swirl chamber 26. The secondary swirl chamber 70 converges on the circular secondary discharge orifice 56 defined by the leading edge of the conical wall portion 64 at the front end of the secondary nozzle body 16. Fluid passing into the secondary swirl chamber 70 is caused to swirl therein by the action of the swirl vanes which are inclined to the axis of the nozzle for imparting tangential spin to the fluid passing therethrough, as is well known in the art. The swirling secondary fluid is discharged out through the secondary discharge orifice 56 to form a hollow conical spray. Depending on design parameters, the secondary conical spray may be separate from or combined with the primary conical spray.

Like the primary nozzle body 14, the secondary nozzle body 16 has a plurality of swirl vanes 78 formed around the periphery of an intermediate cylindrical portion 80 thereof. However, here the swirl vanes operate to swirl air that is being introduced from an air inlet 82 into an annulus 84 formed between the secondary nozzle body and the outer nozzle body 18, the latter being telescoped over the secondary nozzle body 16 and supported on the radially outer ends of the swirl vanes 78. As is known in the art, the nozzle 10 may be surrounded by a housing which channels pressurized air to the air inlet 82.

The outer air nozzle body 18 has a conical wall portion 88 which has an interior conical wall surface 90 that surrounds the outer conical wall surface 92 of the conical wall portion 64 of the secondary nozzle body 14. These conical surfaces 90 and 92 are parallel and define therebetween a conical swirl annulus or chamber 93 generally surrounding the secondary and primary swirl chambers 26 and 70. The air swirl chamber 93 converges on a circular air discharge orifice 94 defined by the leading edge of the conical wall portion 88 at the front end of the outer nozzle body 18. Fluid passing into the air swirl chamber is caused to swirl therein by the action of the swirl vanes which are inclined to the axis of the nozzle for imparting tangential spin to the air passing therethrough, as is well known in the art. The swirling air fluid is discharged out through the air discharge orifice 94 for interaction with the conical sprays issuing from the primary and secondary discharge orifices for enhancing atomization of the fluid. As is known in the art, the air may also be used to influence the conical spray angle.

As best shown in FIG. 2, the swirl slots 37 in the swirl plug 32 are circumferentially equally spaced apart and are sloped or tangential to the center axis 20 of the nozzle for causing swirling of the fluid in the swirl chamber. As a result, a forward projection of the cross-section of each swirl slot (or more particularly the swirl channel defined by the swirl slot in conjunction with the interior conical wall surface 24 shown in FIG. 1) along the center line of the swirl slot (channel) will intersect the plane of the discharge orifice radially outwardly of the discharge orifice. The center line of the swirl slot (channel) at the exit end of the swirl slot (channel) is a line that points in the direction that fluid is guided by the swirl slot (channel) into the swirl chamber and intersects the geometric center (or centroid) of the fluid flow exiting the swirl slot (channel) into the swirl chamber, the centroid typically being coincident with the center of the cross-sectional area of the slot (channel) perpendicular to the center line. Thus, one looking through the discharge orifice along the center line of the swirl slot (channel) would not see any portion of the swirl slot (channel). It further is noted that the center lines of the swirl slots define at the back wall of the swirl chamber (i.e., at the exit openings of the swirl slots, or more particularly the transaxial plane of such exit openings that is intersected by the center lines at circle defining points) a circle having a diameter typically greater than the diameter of the discharge orifice by a factor of 1.25 or more.

The foregoing arrangement gives rise to a fine, circumferentially uniform spray which is desirable for many applications, as for even mixing of fuel with combustion air. However, as above mentioned, the kinetic energy of the typically small spray droplets decreases rapidly with distance from the nozzle. In a gas turbine combustion system, the spray therefore should originate close to the combustion air stream so that the kinetic energy of the fuel spray can provide adequate penetration into and mixing with the combustion air. In some combustion system designs this may not be possible and the fuel spray must travel a relatively long distance from the nozzle to the combustion air. In these cases the fuel spray (droplets) may not have enough kinetic energy to penetrate and mix well with the combustion air before burning, with the result being poor combustion performance.

Figure 3:
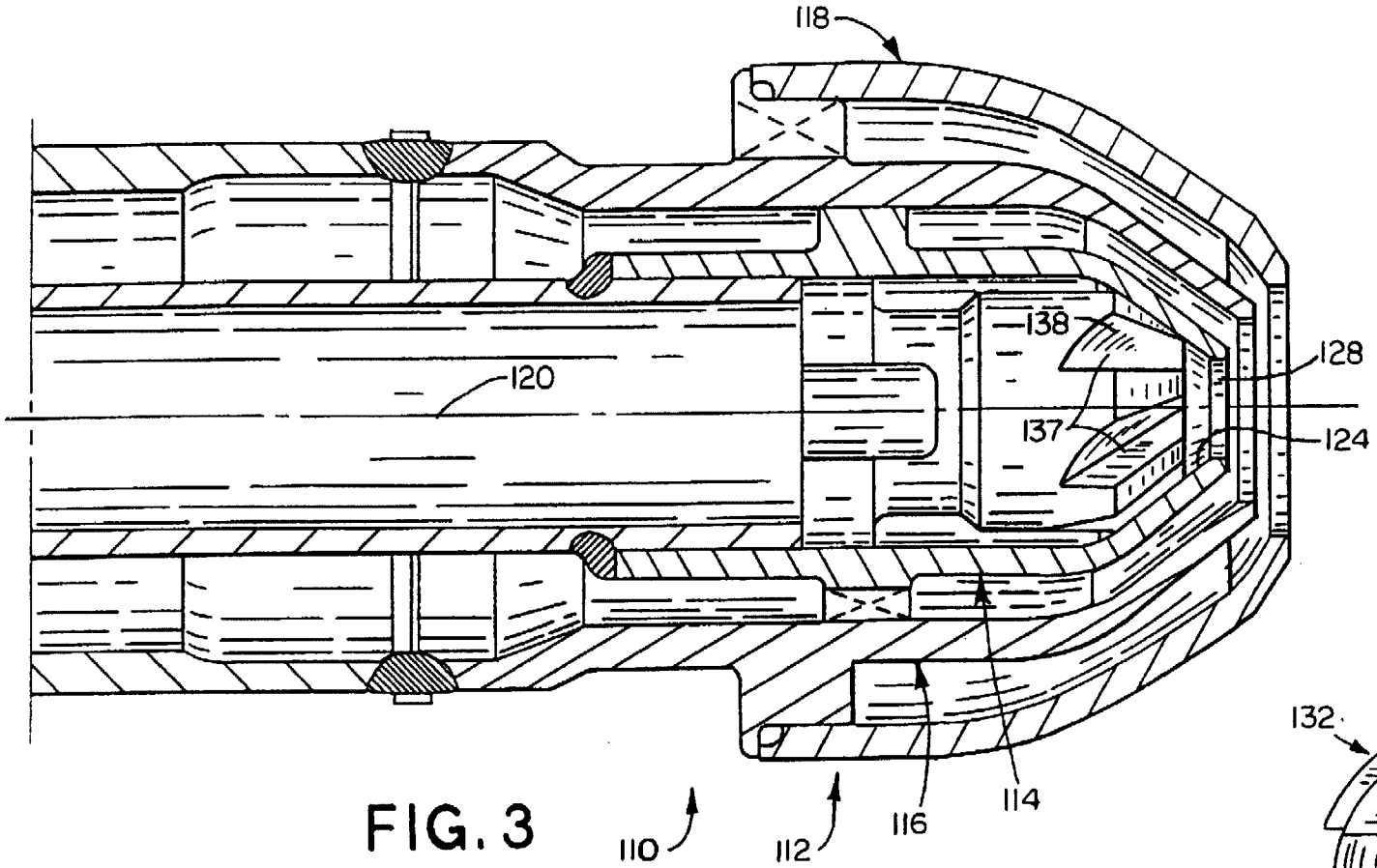
FIG. 3 is a longitudinal cross-sectional view of a nozzle according to the present invention.

The present invention, which resolves the aforesaid problem, is exemplified by the preferred embodiment of spray nozzle shown in FIG. 3 and is denoted by reference numeral 110. The spray nozzle 110 is identical to the above described spray nozzle 10 except as otherwise indicated below. For ease in comparing the two nozzle constructions in order to gain a full understanding of the invention, the elements of the nozzle 110 corresponding to those identified above are denoted by the same reference numeral preceded by a "1" (i.e., incremented by 100).

As in the prior art nozzle 10 described above, the nozzle 110 is a dual circuit/orifice, air assisted nozzle. The nozzle 110 comprises a nozzle body 112 including a primary nozzle body 114, a secondary nozzle body 116 and an outer air nozzle body 118. The nozzle bodies are assembled concentrically with respect to one another and the center axis 120 of the nozzle as shown.

Figure 5:
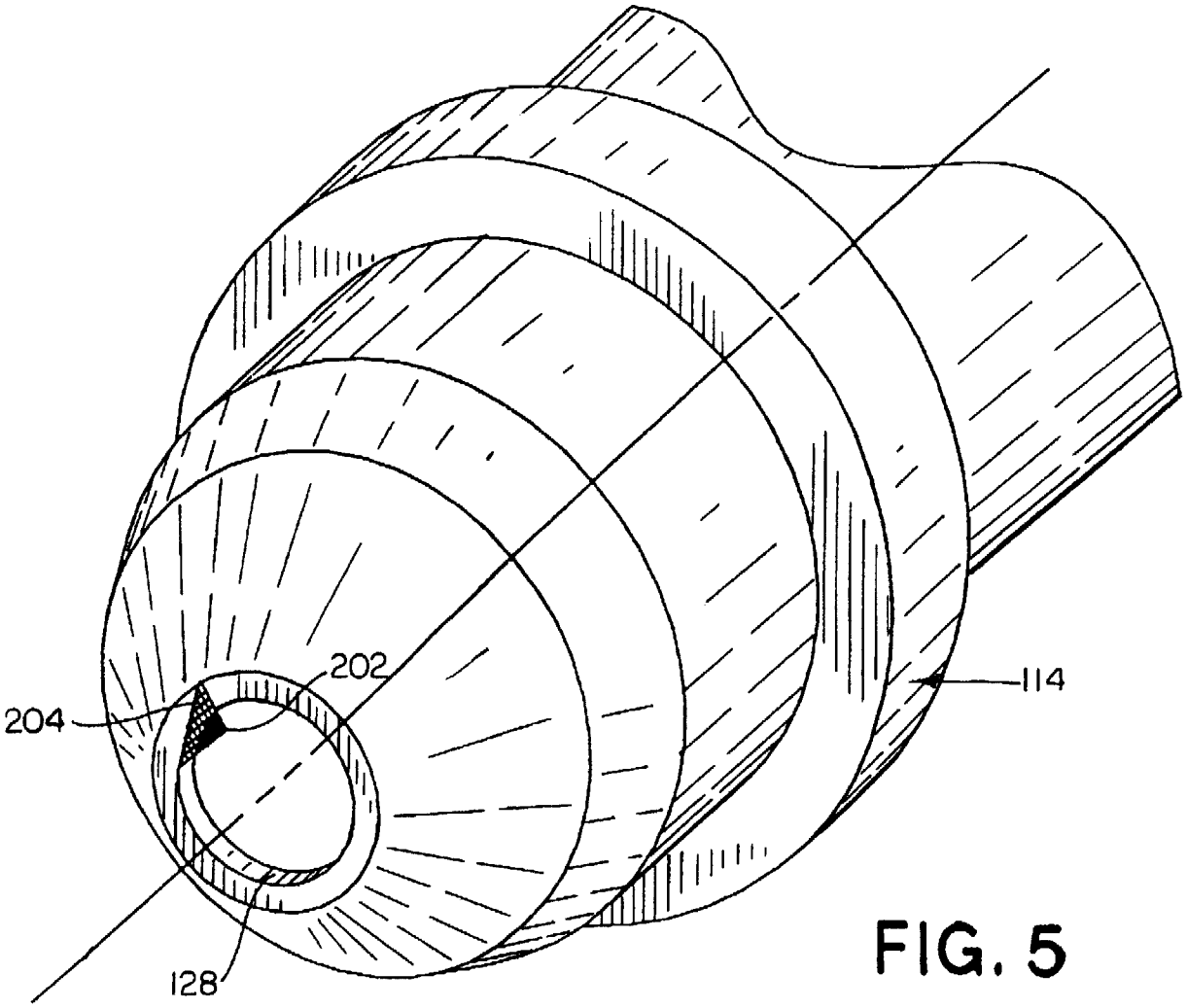
FIG. 5 is a view looking upstream at the primary discharge orifice along a center line of one of the swirl slots in the swirl plug.

The nozzle 110 according to the present invention differs from the prior art nozzle in the following respects. The swirl slots 137 are formed radially deeper relative to the swirl slots 37. As a result, a forward projection of the cross-section of each swirl slot (or more particularly the swirl channel 138 defined by the swirl slot in conjunction with the interior conical wall surface 124) along the center line of the swirl slot (channel) will have a radially inner portion of such projection overlapping the discharge orifice at its intersection with the discharge orifice (or more generally the plane of the discharge orifice). Again, the center line of the swirl slot (channel) at the exit end of the swirl slot (channel) is a line that points in the direction that fluid is guided by the swirl slot (channel) into the swirl chamber and intersects the geometric center (or centroid) of the fluid flow exiting the swirl slot (channel) into the swirl chamber, the centroid typically being coincident with the center of the cross-sectional area of the slot (channel) perpendicular to the center line. Thus, one looking through the primary discharge orifice 128 along the center line of the swirl slot (channel) would, as illustrated in FIG. 5, see a radially inner portion 202, herein referred to as a "see-thru" or "jet" area of the swirl slot (channel), while the remainder of the swirl channel is hidden from view as depicted by the cross-hatching 204. It further is noted that the center lines of the swirl slots define at the back wall of the swirl chamber (i.e., at the exit openings of the swirl slots, or more particularly the transaxial plane of such exit openings that is intersected by the center lines at circle defining points) a circle having a diameter about equal or less than the diameter of the discharge orifice, and thus at a ratio of the diameters that is significantly less than that typically associated with the prior art nozzle.

The foregoing arrangement is believed to allow some of the primary fluid, such as a liquid fuel, to pass or "jet" through the primary discharge orifice without prefilming on the edge or lip of the discharge orifice. In any event, streaks or spokes of heavy fuel concentration are produced in the conical spray with a conventional thin film produced fine, uniform mist between the spokes. The resultant non-uniform spray provides, for example, better penetration into and mixing of fuel with combustion air that may be supplied, for example, outwardly of a nozzle housing shown in broken lines in FIG. 6.

As a comparison of the swirl chambers of the nozzle 10 and nozzle 110 will reveal, the swirler plug may be lengthened in conjunction with the deeper swirl slots. This may be done to maintain the same tip flow number as the nozzle 10 (i.e., the same mass flow rate for the same pressure drop across the nozzle), with all other variables remaining the same except for the depth of the swirl slots. Hence, it will be appreciated that an existing design of nozzle, such as that shown in FIG. 1, may be easily converted to provide a streaked spray simply by replacing the swirl plug.

Figure 4:
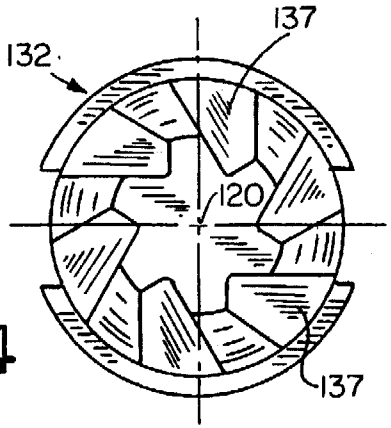
FIG. 4 is an end elevational view of a swirl plug used in the nozzle of FIG. 3.

In the nozzle 110 illustrated in FIGS. 3 and 4, the number of streaks is equal to the number of swirl grooves, such as six. As is preferred, the swirl grooves, and consequently the streaks, are circumferentially uniformly spaced apart to provide a circumferentially non-uniform but axially symmetric spray.

Figure 6:
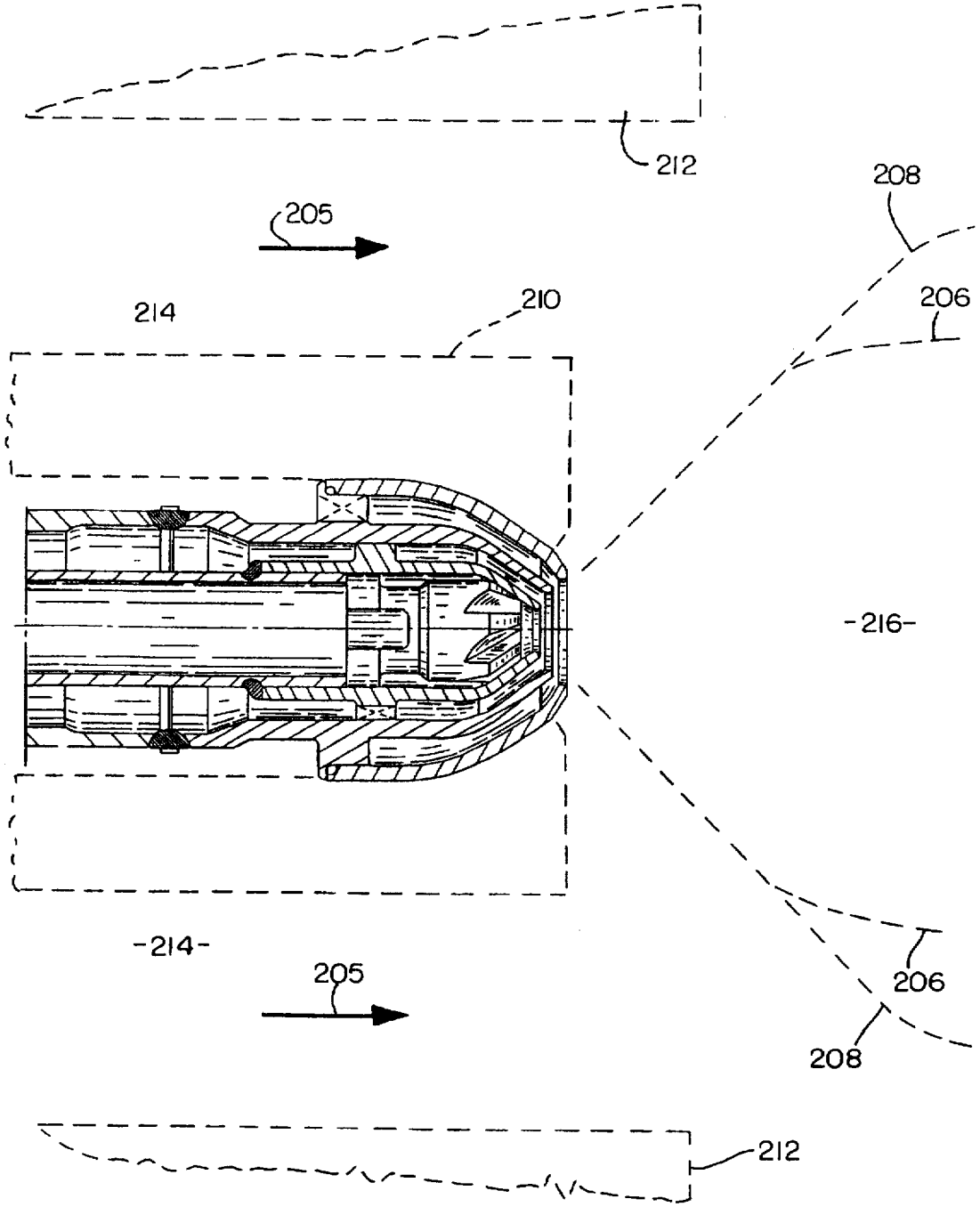
FIG. 6 is a longitudinal cross-sectional view of the nozzle of FIG. 3 assembled in a combustion system which is only partially and schematically illustrated for environmental purposes.

Preferably about 20 to 95 percent of the primary liquid entering the swirl chamber passes (or "jets") through the primary discharge orifice and more preferably about 50 to 90 percent and still more preferably about 80 to 90 percent, while the rest resides in the fine mist between the spokes. Thus, in the exemplary case of a gas turbine combustion system such as that depicted in FIG. 6, the less dense mist between the spokes will intermix with the more adjacent portion of an air stream (arrows 205) as depicted by broken lines 206, while the more dense spokes, having higher kinetic energy, will penetrate further into the combustion air stream and intermix with more remote air as depicted by broken lines 208. The result is better overall mixing of the fluid in those instances where the fuel spray must travel a relatively long distance from the nozzle to the combustion air, such as distances greater than about ½ inch (1¼ cm) or even greater than about ¾ inch (1⅞ cm), or more. In FIG. 6, the nozzle is shown as installed in a housing 210 which defines with other structure 212 a passageway 214 for the combustion air opening into combustion chamber 216.

Although the invention has been shown and described with respect to a certain preferred embodiment, alterations and modifications will no doubt occur to others skilled in the art upon the reading and understanding of this specification. For example, the invention has application to nozzles other than a dual orifice, air assisted nozzle such as, by way of further example, a single orifice nozzle with or without air assist. Also, swirl channels may be formed by other than swirl slots, such as for example by swirl holes in the swirl plug or other element. Moreover, the swirl channels formed by combinations of swirl slots, swirl holes, swirl vanes, and/or equivalent devices may be utilized to obtain regions of higher density in the conical spray. As a further modification, radially deeper swirl slots or otherwise formed swirl channels may alternate with radially shallower swirl slots or swirl channels, with the result being fewer streaks and/or heavier streaks alternating with lighter streaks. In addition, although less preferred, one or more swirl channels may be circumferentially spaced apart equally or otherwise to provide other streaked patterns in the conical spray, as may be desired for some applications, and streak-forming swirl channels having center line projections thereof overlapping the discharge orifice may be separate from more radially outwardly disposed swirl channels which impart swirl to the fluid in the swirl chamber alone or in combination with the radially inner streak-forming swirl channels. The present invention includes all such alterations and modifications falling within the spirit of the herein described invention.

What is claimed is:

1. A spray nozzle comprising a nozzle body, a swirl chamber in said nozzle body and having a conical side wall surface terminating at a discharge orifice, said swirl chamber extending axially from a back wall of said swirl chamber to said discharge orifice axially opposite said back wall, a plurality of fluid channels opening to said swirl chamber for conveying a liquid from an inlet to said swirl chamber, at least one of said fluid channels being disposed to cause swirling of the liquid within said swirl chamber for discharge through said discharge orifice to form a conical spray, and at least one of said fluid channels having a center line radially converging toward said discharge orifice and a center line projection thereof at least partially radially overlapping said discharge orifice, whereby at least one higher density streak is produced in the conical spray.

2. A spray nozzle as set forth in claim 1, wherein more than one of said fluid channels each has a center line radially converging toward said discharge orifice and a center line projection thereof at least partially radially overlapping said discharge orifice, whereby a plurality of higher density streaks are produced in the conical spray.

3. A spray nozzle as set forth in claim 2, wherein said fluid channels are equally circumferentially spaced apart.

4. A spray nozzle as set forth in claim 1, wherein more than one of said fluid channels are swirl channels opening tangentially to said swirl chamber, and a center line projection of each said swirl channel has radially inner and outer portions respectively intersecting and not intersecting said discharge orifice.

5. A spray nozzle as set forth in claim 4, wherein said nozzle body includes an outer body member forming said conical side wall surface of said swirl chamber that terminates at said discharge orifice, and an inner body member cooperating with said conical side wall surface to define said swirl chamber.

6. A spray nozzle as set forth in clam 5, wherein said inner body member has a conical portion for mating with said conical side wall surface, and said conical portion has formed therein a plurality of swirl slots, said swirl slots having radially converging center lines and each having a radial depth such that a center line projection thereof radially overlaps said discharge orifice.

7. A spray nozzle comprising a nozzle body including an outer body member forming a conical side wall surface of a conical swirl chamber that terminates at a circular discharge orifice, and an inner member cooperating with said outer conical side wall surface to define said swirl chamber, a plurality of swirl channels in said inner member and opening tangentially to said swirl chamber at a back wall of said swirl chamber for introducing a liquid into said swirl chamber to cause swirling of the liquid within said swirl chamber for discharge through said discharge orifice to form a conical spray, and said swirl channels having center lines defining at the back wall of the swirl chamber a circle coaxial with said discharge orifice, said circle having a diameter about equal or less than said discharge orifice such that a plurality of higher density streaks are produced in the conical spray.

8. A spray nozzle comprising a nozzle body, a swirl chamber in said nozzle body, said swirl chamber extending axially from a back wall of said swirl chamber to a discharge orifice axially opposite said back wall, and means opening to said swirl chamber for conveying a liquid from an inlet to said swirl chamber, said conveying means being operative to cause swirling of the liquid within said swirl chamber for discharge through said discharge orifice to form a conical spray, and further being operative to produce at least one higher density streak in the conical spray.

9. A spray nozzle as set forth in claim 8, wherein said conveying means comprises a plurality of channel means, at least one of said channel means being disposed to cause the fluid to jet through said discharge orifice for producing at least one higher density streak in the conical spray.

10. A spray nozzle as set forth in claim 9, wherein more than one of said channel means each is disposed to cause the fluid to jet through said discharge orifice for producing a respective higher density streak in the conical spray.

11. A spray nozzle as set forth in claim 10, wherein said channel means are equally circumferentially spaced apart.

12. A spray nozzle as set forth in claim 8, wherein said conveying means includes a plurality of swirl channels opening tangentially to said swirl chamber, and a center line projection of each said swirl channel has radially inner and outer portions respectively intersecting and not intersecting said discharge orifice.

13. A spray nozzle as set forth in claim 8, wherein said nozzle body includes an outer body member forming an conical side wall surface of said swirl chamber that terminates at said discharge orifice, and an inner body member cooperating with said conical side wall surface to define said swirl chamber.

14. A spray nozzle as set forth in clam 13, wherein said inner body member has a conical portion for mating with said conical side wall surface, and said conveying means includes a plurality of swirl slots formed in said conical portion, said swirl slots having a radial depth such that a center line projection thereof radially overlaps said discharge orifice.

15. A spray nozzle as set forth in claim 8, further comprising the liquid flowing through said swirl channels for forming a conical spray with at least one higher density streak in the conical spray.

16. A method of converting a spray nozzle comprising a nozzle body including an outer body member forming a conical side wall surface of a swirl chamber that terminates at a circular discharge orifice, and a swirl plug cooperating with said outer conical side wall surface to define said swirl chamber, a plurality of swirl channels in said swirl plug and opening tangentially to said swirl chamber for introducing fluid into said swirl chamber to cause swirling of the fluid within said swirl chamber for discharge through said discharge orifice to form a conical spray, and said swirl channels having center lines defining at the back wall of said swirl chamber a circle coaxial with said discharge orifice, said circle having a diameter greater than said discharge orifice, said method comprising the step of replacing said swirl plug with a replacement swirl plug, said replacement swirl plug cooperating with said outer conical side wall surface to define said swirl chamber, said replacement swirl plug having a plurality of swirl channels opening tangentially to said swirl chamber for introducing fluid into said swirl chamber to cause swirling of the fluid within said swirl chamber for discharge through said discharge orifice to form a conical spray, said swirl channels in said replacement swirl plug having center lines defining at the back wall of said swirl chamber a circle coaxial with said discharge orifice, and said circle having a diameter about equal or less than said discharge orifice, whereby a plurality of higher density streaks may be produced in the conical spray.

17. A method of using a spray nozzle, the spray nozzle comprising a nozzle body, a swirl chamber in said nozzle body and having a conical side wall surface terminating at a discharge orifice, said swirl chamber extending axially from a back wall of said swirl chamber to said discharge orifice axially opposite said back wall, a plurality of fluid channels opening to said swirl chamber for conveying a liquid from an inlet to said swirl chamber, at least one of said fluid channels being disposed to cause swirling of the liquid within said swirl chamber for discharge through said discharge orifice to form a conical spray, and at least one of said fluid channels having a center line projection thereof at least partially radially overlapping said discharge orifice, whereby at least one higher density streak is produced in the conical spray, and said method comprising the step of supplying a liquid through said inlet for passage through said fluid channels into said swirl chamber and out through said discharge orifice, using at least one of said fluid channels to cause swirling of the fluid within said swirl chamber for discharge through said discharge orifice to form a conical spray, and using at least one of said fluid channels, having a center line projection thereof at least partially radially overlapping said discharge orifice, to produce at least one higher density streak in the conical spray.

18. A method as set forth in claim 17, wherein a plurality of said fluid channels are used to produce respective higher density streaks in the conical spray.

19. A method as set forth in claim 18, wherein the higher density streaks are equally circumferentially spaced apart.

20. A method as set forth in claim 17, including the step of positioning the spray nozzle in an air stream with said at least one higher density streak penetrating into the air stream a distance greater than the penetration of the conical spray.

21. A method as set forth in claim 17, wherein about 20 to 95 percent of the liquid exiting said swirl chamber through said discharge orifice resides in the higher density streaks.

22. A method as set forth in claim 17, wherein about 50 to 90 percent of the liquid exiting said swirl chamber through said discharge orifice resides in the higher density streaks.

23. A method as set forth in claim 17, wherein about 80 to 90 percent of the liquid exiting said swirl chamber through said discharge orifice resides in the higher density streaks.

24. A spray nozzle in combination with a liquid supplied to said spray nozzle, said spray nozzle comprising a nozzle body, a swirl chamber in said nozzle body and having a conical side wall surface terminating at a discharge orifice, said swirl chamber extending axially from a back wall of said swirl chamber to said discharge orifice axially opposite said back wall, a plurality of fluid channels opening to said swirl chamber for conveying fluid from an inlet to said swirl chamber, at least one of said fluid channels being disposed to cause swirling of the fluid within said swirl chamber for discharge through said discharge orifice to form a conical spray, and at least one of said fluid channels having a center line projection thereof at least partially radially overlapping said discharge orifice, whereby at least one higher density streak is produced in the conical spray; and said liquid flowing through said fluid channels for forming a conical spray with at least one higher density streak in the conical spray.

25. A spray nozzle in combination with a liquid supplied to said spray nozzle, said spray nozzle comprising a nozzle body including an outer body member forming a conical side wall surface of a swirl chamber that terminates at a circular discharge orifice, and an inner member cooperating with said outer conical side wall surface to define said swirl chamber, a plurality of swirl channels in said inner member and opening tangentially to said swirl chamber at a back wall of said swirl chamber for introducing fluid into said swirl chamber to cause swirling of the fluid within said swirl chamber for discharge through said discharge orifice to form a conical spray, and said swirl channels having center lines defining at the back wall of the swirl chamber a circle coaxial with said discharge orifice, said circle having a diameter about equal or less than said discharge orifice such that a plurality of higher density streaks are produced in the conical spray; and said liquid flowing through said swirl channels for forming a conical spray with at least one higher density streak in the conical spray.

26. A spray nozzle comprising a nozzle body, a swirl chamber in said nozzle body and having a conical side wall surface terminating at a discharge orifice, said swirl chamber extending axially from a back wall of said swirl chamber to said discharge orifice axially opposite said back wall, a plurality of swirl channels opening tangentially to said swirl chamber for conveying a liquid from an inlet to said swirl chamber, said swirl channels each opening to the upstream end of said conical side wall surface such that a first portion of the liquid passing therethrough is guided for direct impingement on the conical side wall surface to cause swirling of the liquid within the swirl chamber for discharge through said discharge orifice to form a conical spray and a second portion of the liquid is guided for direct passage out through said discharge orifice to produce a higher density streak in the conical spray.

27. A spray nozzle as set forth in claim 26, further comprising the liquid flowing through said swirl channels for forming a conical spray with at least one higher density streak in the conical spray.

* * * * *